US005816234A

United States Patent [19]

Vasan

[11] Patent Number: 5,816,234

[45] Date of Patent: Oct. 6, 1998

[54] CONVECTION OVEN

[76] Inventor: Laxminarasimhan Vasan, 5459 Adele Ave., Whittier, Calif. 90601

[21] Appl. No.: 885,361

[22] Filed: Jun. 30, 1997

[51] Int. Cl.[6] ..... F24C 15/32

[52] U.S. Cl. ..... 126/21 A; 219/400

[58] Field of Search ..... 126/21 A; 219/400

[56] References Cited

U.S. PATENT DOCUMENTS

| | | | |
|---|---|---|---|
| 3,384,068 | 5/1968 | Perry et al. . | |
| 3,710,775 | 1/1973 | Tamada et al. . | |
| 3,827,346 | 8/1974 | Tropp et al. | 219/400 |
| 3,962,962 | 6/1976 | Anderson | 219/400 |
| 4,233,495 | 11/1980 | Scoville et al. . | |
| 4,430,989 | 2/1984 | Narang et al. | 126/21 A |
| 4,892,030 | 1/1990 | Grieve . | |
| 4,935,604 | 6/1990 | Allen et al. . | |
| 5,276,309 | 1/1994 | Hasse et al. . | |
| 5,309,981 | 5/1994 | Binder . | |
| 5,492,055 | 2/1996 | Nevin et al. . | |
| 5,568,802 | 10/1996 | Buday et al. . | |

*Primary Examiner*—Carroll B. Dority

*Attorney, Agent, or Firm*—Oppenheimer Wolff & Donnelly LLP

[57] ABSTRACT

An oven having a heating element cavity including a heating element, an oven cavity including a plurality of inner walls, at least one of which includes a plurality of vertically and horizontally-spaced wall apertures that are in communication with the heating element cavity such that heated air may be received therefrom, and an air circulation mechanism associated with the oven cavity adapted to force air over the inner surface of the at least one inner wall. Each of the wall apertures may be covered by a louver.

19 Claims, 3 Drawing Sheets

28
42
68
72
33
48
46
74
68
70
38
35
52
34
76
35
58
62
41
56
54
43
64
66
40
60
76
70
44
68
72
48
46
74
33
38
35
26
32
36
37
50

28
32
33
35
46
48
68
72
74
76
34
58
62
35
54
56
41
64
66
36
60
37
40
76
68
74
26
68
72
48
35
46
50
52

CONVECTION OVEN

BACKGROUND OF THE INVENTION

1. Field of Invention

The present invention relates generally to ovens and, more particularly, to ovens with air circulation mechanisms.

2. Description of the Related Art

Referring to FIG. 1, which is an illustration of a conventional convection oven intended for home use, conventional convection ovens typically include an oven cavity 10 and a heating element cavity 12 which includes a heating element (not shown) such as a gas burner. Oven cavities can be somewhat large. In fact, many oven cavities have a series of racks 14 that allow baking pans to be stacked within the oven cavity. A gap 16 is located between the oven wall 18 and the oven cavity floor 20. Due to the fact that hot air tends to rise relative to cooler air, air which is heated in the heating element cavity 12 travels upwardly into the oven cavity 10 through the gap 16. Some ovens also include small vents 21 in the oven cavity floor that allow heated air to pass into the oven cavity. Eventually, the air will pass through a vent 23.

Hot air which enters the oven cavity 10 of conventional convection ovens in this manner is not evenly distributed throughout the oven cavity (i.e. front to back, top to bottom, and side to side). As a result, the food products located therein are not evenly cooked. For example, sheets of cookies baked in a conventional convection oven will often have to be removed, rotated and returned to the oven in order to obtain even baking from cookie to cookie. The baking sheets may also have to be redistributed vertically because the top to bottom heat distribution within the oven cavity is not even.

In an attempt to more evenly distribute hot air over the food products within the oven cavity, conventional convection ovens include an air circulation mechanism, such as the fan 22 shown in FIG. 1. The fan 22 creates turbulence and circulates hot air within the oven cavity 10 by drawing air from the center of the oven cavity and then forcing it out from behind a baffle 24 in the manner shown by the arrows in FIG. 1. The fan 22 may also create a small pressure difference between the heating element cavity 12 and the oven cavity 10 which helps draw hot air into the oven cavity. The flow of hot air through the vent 23 also causes upward movement of hot air from the heating element cavity 12 to the oven cavity 10.

Most commercially sized convection ovens do not allow hot air into the oven cavity through gaps between the oven cavity wall and floor as shown in FIG. 1. Instead of the gaps, there is an exterior cavity that extends from the heating element cavity, around the exterior of the oven cavity and over the top surface of the oven cavity. A tube, which defines the only connection between the exterior cavity and the oven cavity, extends downwardly through the top surface of the oven cavity to a point adjacent to the fan. The fan draws hot air through the tube and then distributes the hot air in a manner similar to that shown in FIG. 1.

While the use of fans has improved heat distribution to some extent, heat distribution within conventional convection ovens intended for home use is still far from optimal. The efficiency of conventional convection ovens intended for commercial use is also far from optimal because the hot air produced in the heating element cavity loses energy as it heats the walls along its somewhat tortured path to the oven cavity. Additionally, conventional commercial convection ovens require a powerful fan to operate in the manner described above. Such a fan produces high pressure within the oven cavity which, in turn, forces much of the hot air out of the oven cavity through the vent. Therefore, a need exists for methods of improving the heat distribution and efficiency of convection ovens.

SUMMARY OF THE INVENTION

Accordingly, the general object of the present invention is to provide a convection oven which avoids, for practical purposes, the aforementioned problems. In particular, one object of the present invention is to provide a convection oven which distributes heat within the oven cavity in a more even manner than conventional convection ovens.

In order to accomplish these and other objectives, an oven in accordance with one embodiment of the present invention includes a heating element cavity including a heating element, an oven cavity including a plurality of inner walls, at least one of which includes a plurality of vertically and horizontally-spaced wall apertures that are in communication with the heating element cavity such that heated air may be received therefrom, and an air circulation mechanism associated with the oven cavity that is adapted to force air over the inner surface of the at least one inner wall of the oven cavity.

This aspect of the present invention provides a number of advantages over the prior art. For example, the present invention provides superior front to back, top to bottom and side to side heat distribution than convection ovens known heretofore. The present invention also operates more efficiently than conventional commercial convection ovens because the hot air in the present oven is not forced to travel over the aforementioned tortured path to the oven cavity. Additionally, because the present oven does not require the relatively powerful fan associated with conventional commercial convection ovens, large amounts of hot air is not unnecessarily and inefficiently forced through the vent.

In accordance with another advantageous embodiment of the present invention, each of the wall apertures may be covered by a louver. The louvers prevent the air forced over the inner surface of the oven cavity inner wall from interfering with the flow of air through the apertures.

The present invention is also applicable to ovens intended for home use as well as those intended for commercial use.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the invention will be made with reference to the accompanying drawings.

DETAILED DESCRIPTION OF THE PREFERRED EMBODIMENT

The following is a detailed description of the best presently known mode of carrying out the invention. This description is not to be taken in a limiting sense, but is made merely for the purpose of illustrating the general principles of the invention. The scope of the invention is defined by the appended claims.

Figure 1:
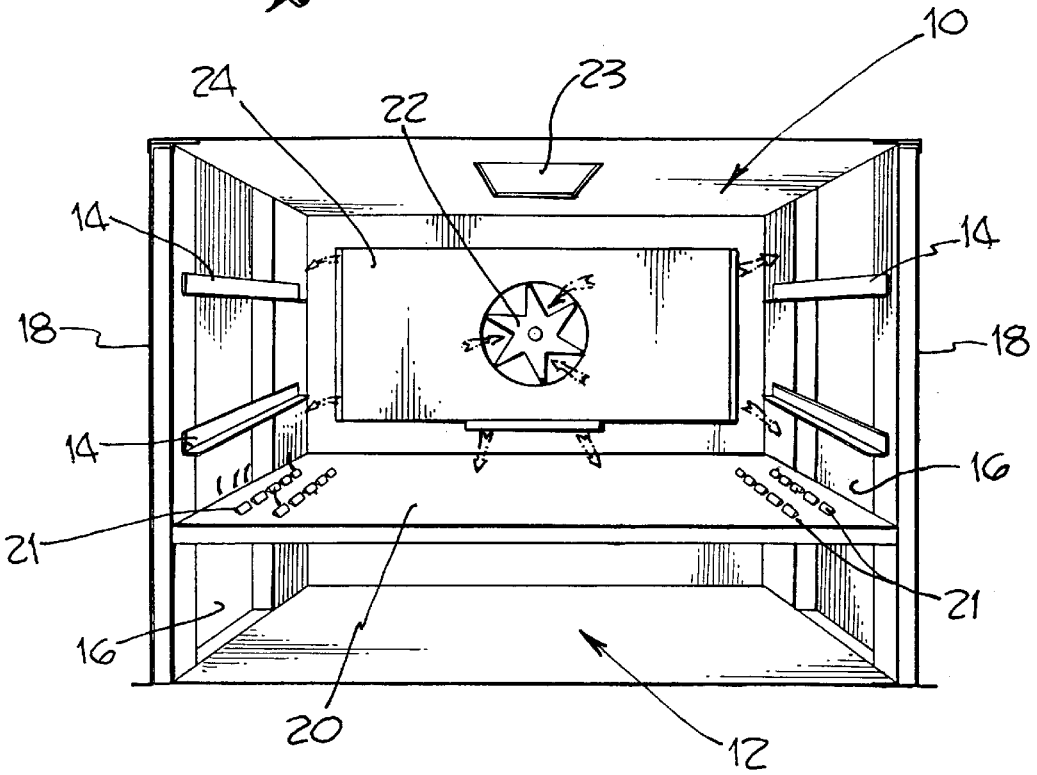
Fig. 1. PRIOR ART
FIG. 1 is a perspective view of the interior of a conventional convection oven intended for residential use.
Figure 2:
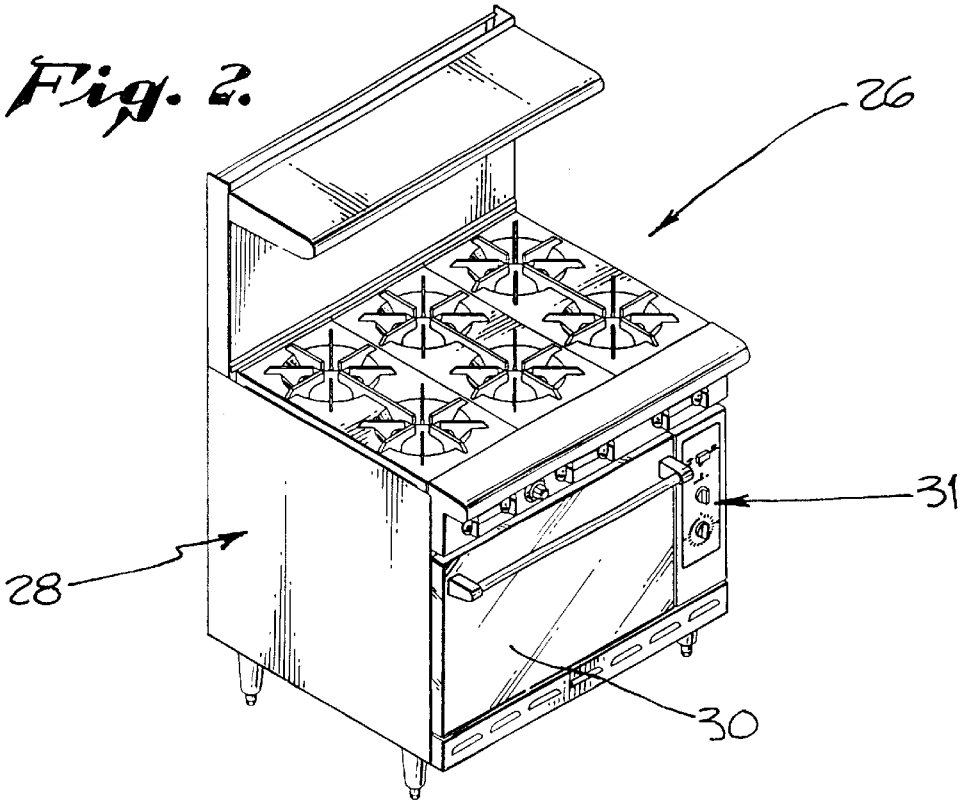
FIG. 2 is a perspective view of a convection oven in accordance with a preferred embodiment of the present invention.
Figure 3:
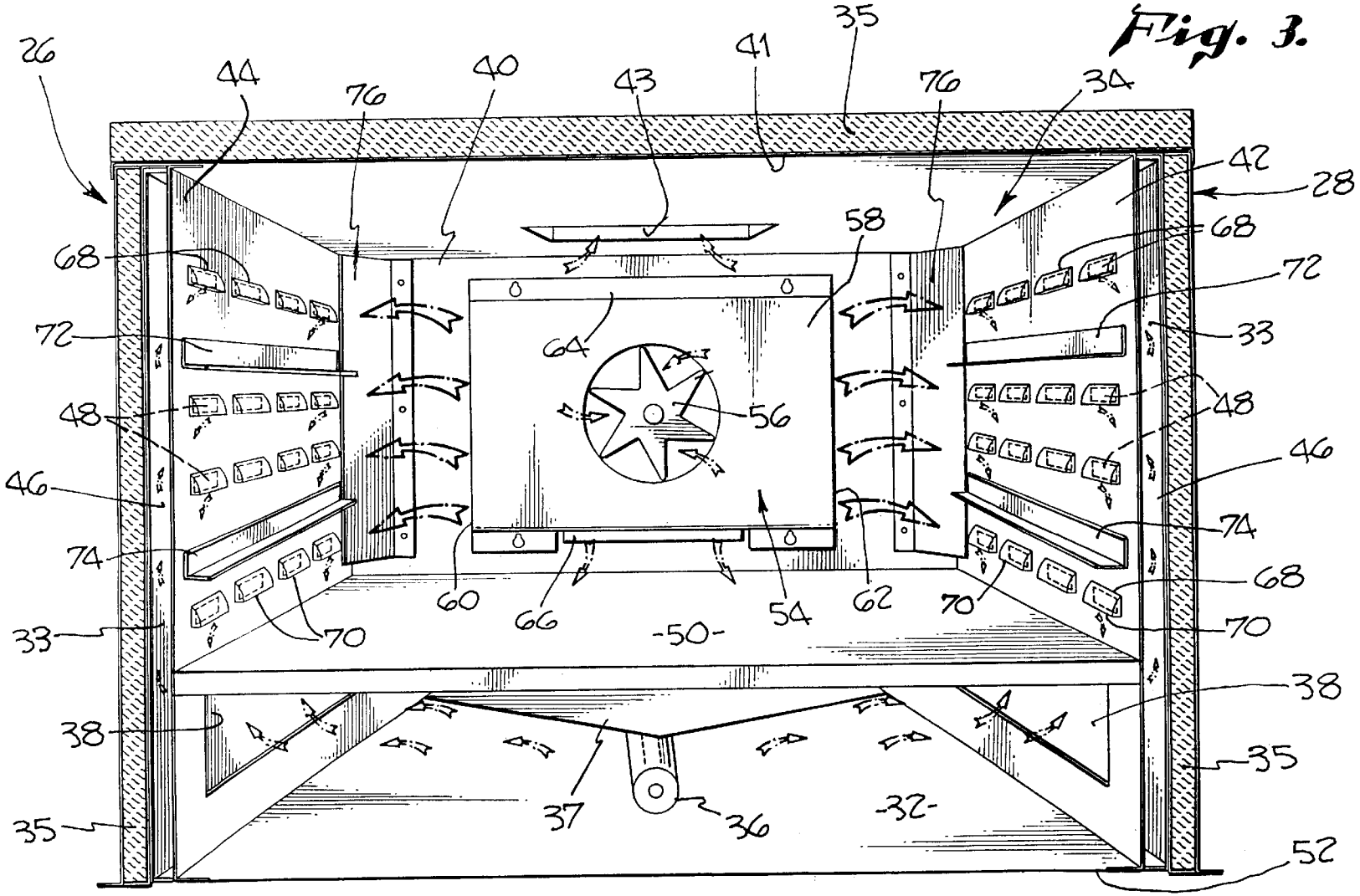
FIG. 3 is a perspective view of the interior of a convection oven in accordance with a preferred embodiment of the present invention.
Figure 4:
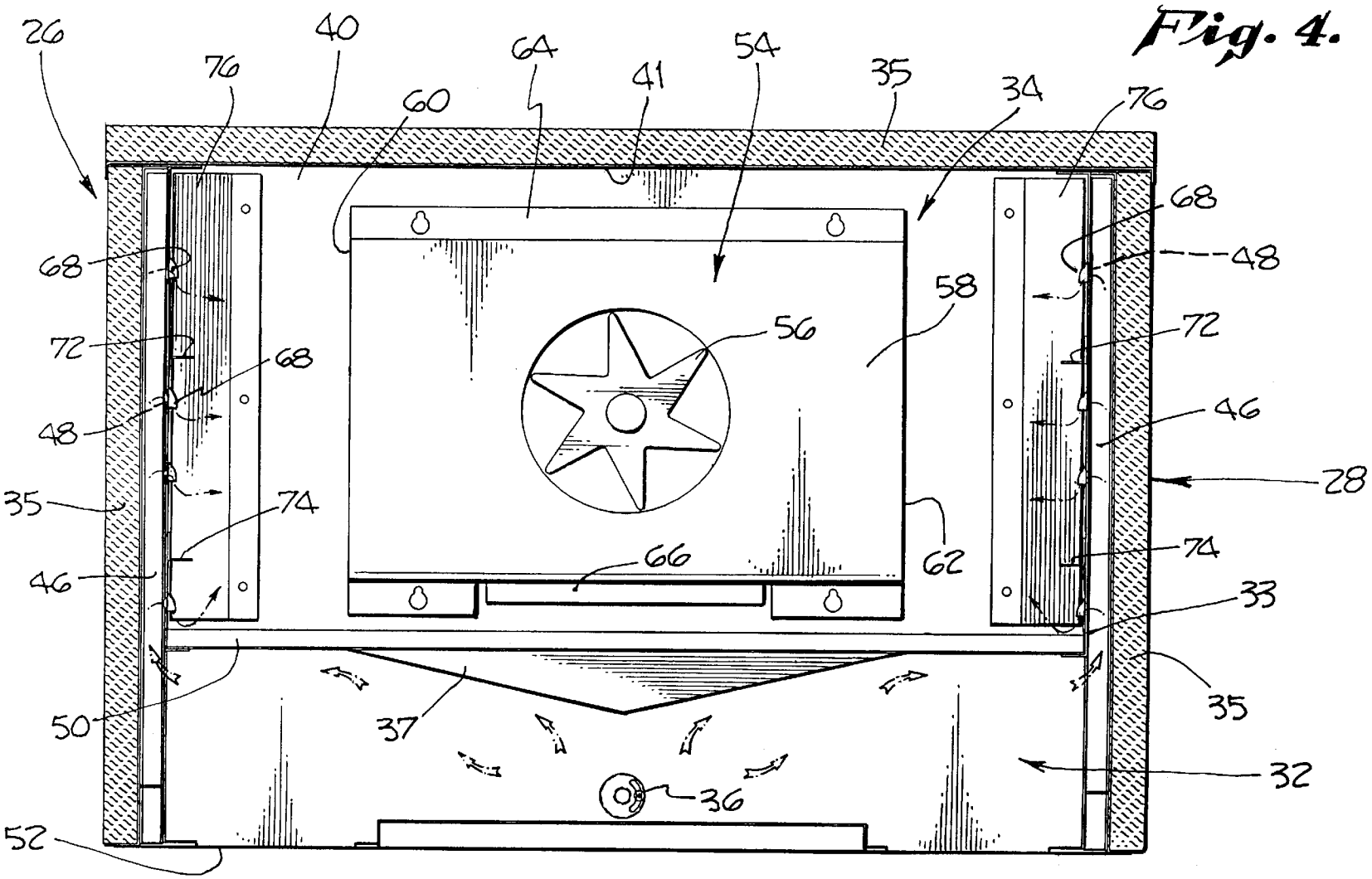
FIG. 4 is a front view of the interior of a convection oven in accordance with a preferred embodiment of the present invention.

As illustrated for example in FIGS. 2–4, a convection oven 26 in accordance with a preferred embodiment of the present invention includes a housing 28 having a door 30 and controls 31. The oven also includes a heating element cavity 32 and an oven cavity 34. The heating cavity 32 includes a heating element 36 which, in the exemplary embodiment, is a gas burner and, optionally, a deflector 37. A pair of openings 38 are also provided. The oven cavity 34 is defined in part by inner walls 40, 42 and 44. A pair of passages 46 are formed between inner walls 42 and 44 and the housing 28. Inner walls 42 and 44 also include a plurality of apertures 48 which are spaced front to back and top to bottom along the inner walls. The oven cavity also includes a roof 41 having a vent 43.

In the illustrated embodiment, the heating element cavity 32 and oven cavity 34 are separated by a floor 50 which abuts the inner walls 40, 42 and 44. Preferably, the floor 50 abuts the inner walls and creates an air tight seal therewith. Thus, the openings 38, passages 46 and apertures 48 define the only pathway for heated air to travel between the heating element cavity 32 and oven cavity 34. As best seen in FIG. 4, the exemplary inner walls 40, 42, and 44 extend downwardly to the oven base 52 and, therefore, form the walls of the heating element cavity 32.

In the exemplary embodiment, the inner walls 40, 42 and 44 are liners, which are formed from materials such as stainless steel or cold rolled steel with a porcelain finish. The housing 28 includes a heat shield 33 as well as insulation 35.

An air circulation mechanism 54 is associated with inner wall 40 which, in the illustrated embodiment, is the rearward wall. The exemplary air circulation mechanism 54 draws in air from approximately the center of the oven cavity 34. Some of the air is then forced over inner walls 42 and 44 as shown with the relatively large arrows in FIG. 3. As shown by way of example in FIGS. 3 and 4, the air circulation mechanism 54 includes a fan 56 and a baffle 58. The fan 56 draws air from the center of the oven cavity 34. The exemplary baffle 58, which is primarily composed of a plate that is located in spaced relation to the inner wall 40, defines longitudinal ends 60 and 62, a top end 64 and a bottom end 66. In the exemplary embodiment, the baffle includes a top plate (not shown) that extends to the inner wall 40, thereby preventing air drawn into the baffle 58 by the fan 56 from exiting through the top end 64. Conversely, the side ends 60 and 62 and at least a portion of the bottom end 66 are open so that air drawn into the baffle may flow outwardly therefrom in the manner shown in FIG. 3.

In accordance with another aspect of the illustrated embodiment, louvers 68 cover each of the apertures 48. The louvers 68 include downwardly facing openings 70 which allow hot air to pass from the apertures 48 to the oven cavity 34 as illustrated, for example, in FIGS. 3 and 4. During operation, air traveling at a relatively high speed from the longitudinal ends 60 and 62 of the baffle passes over the louvers 68, thereby creating a suction force at the openings 70 which helps draw hot air through the apertures 48. As best seen in FIG. 3, the exemplary louvers 68 include side portions which are generally perpendicular to the inner walls and a curved top portion. Other louver configuration will also produce satisfactory results. For example, a louver may simply consist of a plate which extends from a portion of the oven cavity inner wall adjacent to an aperture 48 and which is located between the aperture and the air circulation mechanism 54. The louvers prevent the air forced over the inner walls 42 and 44 from interfering with the flow of air through the apertures 48.

With respect to the number and spacing of the apertures 48 (and louvers 68), there is preferably one row (extending front to back) of apertures above and below each rack. Where, as shown by way of example in FIGS. 3 and 4, there are two racks 72 and 74 on each inner wall, there will be four rows of apertures. In an oven intended for residential use which produces approximately 18 to 30 kBTU, the rows are preferably about 1 to 2 inches above and below the racks. In a commercial oven which produces approximately 20 to 80 kBTU, the vertical aperture to rack spacing is preferably about 2 to 3 inches. Turning to horizontal (or front to back) spacing, the apertures 48 are preferably about ½ to 1 inch apart in a residential oven that is approximately 18 to 22 inches deep and about ½ to 1 inch apart in a commercial oven that is approximately 20 to 29 inches deep. The apertures themselves are preferably 4 to 6 inches in length and ¾ to 1 inch in height in both residential and commercial ovens.

The oven cavity in the illustrated embodiment is preferably rectangular and, therefore, adjacent inner walls 40, 42 and 44 define 90 degree angles therebetween. In order to redirect air that is forced from the longitudinal ends 60 and 62 of the baffle 58, the air circulation mechanism in illustrated embodiment also includes a pair of deflectors 76. The deflectors 76 insure that the air will be directed over the apertures 48 and louvers 68.

Although the present invention has been described in terms of the preferred embodiment above, numerous modifications and/or additions to the above-described preferred embodiments would be readily apparent to one skilled in the art. It is intended that the scope of the present invention extends to all such modifications and/or additions and that the scope of the present invention is limited solely by the claims set forth below.

I claim:

1. An oven, comprising:

a heating element cavity including a heating element adapted to heat air within the heating element cavity;

an oven cavity including a vent and a plurality of inner and outer walls, the inner walls defining inner surfaces and outer surfaces, at least one of the inner walls including a plurality of wall apertures and a plurality of air deflectors respectively associated with the wall apertures, the wall apertures being in communication with the heating element cavity by way of a passage formed between the inner and outer walls such that heated air may be received therefrom; and an air circulation mechanism located within the oven cavity adapted to force air from within the oven cavity over the inner surface of the at least one inner wall such that heated air from the heating element cavity is drawn through the wall apertures into the oven cavity.

2. An oven as claimed in claim 1, wherein the heating element comprises a gas burner.

3. An oven as claimed in claim 1, wherein the heating element cavity and oven cavity are separated by a floor.

4. An oven as claimed in claim 3, wherein the floor abuts the inner surfaces of the inner walls and provides a substantially air tight seal between the heating element cavity and the oven cavity.

5. An oven as claimed in claim 1, wherein the outer walls comprise heat shields.

6. An oven as claimed in claim 1, wherein the air circulation mechanism comprises a fan.

7. An oven, comprising:

a heating element cavity including a heating element adapted to heat air within the heating element cavity;

an oven cavity including a vent and a plurality of inner walls defining inner surfaces and outer surfaces, at least one of the inner walls including a plurality of wall apertures, the wall apertures being in communication with the heating element cavity such that heated air may be received therefrom; and an air circulation mechanism associated with the oven cavity adapted to force air over the inner surface of the at least one inner wall, the air circulation mechanism including a fan and a baffle defining longitudinal ends and located in spaced relation to one of the inner walls, thereby defining a baffle space therebetween, and wherein the fan is arranged such that it draws air from within the oven cavity, drives the air into the baffle space, and drives the air beyond the longitudinal ends of the baffle.

8. An oven as claimed in claim 7, wherein the baffle defines an upper end and a lower end, the upper end is substantially closed, and the lower end defines an opening.

9. An oven as claimed in claim 7, wherein the air circulation mechanism further comprises an air deflector located between one of the longitudinal ends of the baffle and the at least the innerwall including a plurality of wall apertures.

10. An oven as claimed in claim 1, wherein the oven cavity includes first, second and third inner walls, the first and second walls define a first junction therebetween, the second and third walls define a second junction therebetween, and the first and third walls are in spaced relation to one another, and wherein the first and third walls each include a plurality of wall apertures and the air circulation mechanism is associated with the second wall.

11. An oven as claimed in claim 10, wherein the air circulation mechanism comprises a first air deflector located in the first junction and a second air deflector located in the second junction.

12. An oven as claimed in claim 10, wherein the first and second walls define an approximately 90 degree angle therebetween and the second and third walls define an approximately 90 degree angle therebetween.

13. An oven as claimed in claim 1, wherein the air deflectors comprise louvers covering the respective wall apertures.

14. An oven as claimed in claim 13, wherein the louvers define respective openings and at least one of the openings faces downwardly.

15. An oven as claimed in claim 1, wherein the wall apertures are horizontally and vertically spaced along the at least one inner wall.

16. An oven, comprising:

a housing;

a heating element cavity within the housing and in spaced relation thereto, the heating element cavity including a heating element adapted to heat air within the heating element cavity and at least one heating element cavity opening in communication with a space between the housing and the heating element cavity;

an oven cavity within the housing and in spaced relation thereto, the oven cavity including a vent and at least first, second and third inner walls defining inner surfaces and outer surfaces, the first and second inner walls defining a first junction therebetween, the second and third inner walls defining a second junction therebetween, the first and third inner walls being in spaced relation to one another, and the first and third inner walls each including a plurality of horizontally and vertically spaced wall apertures in communication with a space between the housing and the oven cavity and the space between the housing and heating element cavity;

a barrier separating the heating element cavity and the oven cavity and providing a substantially air tight seal therebetween such that air from the heating element cavity can only reach the oven cavity by way of the space between the housing and the oven cavity and the space between the housing and heating element cavity;

a plurality of louvers respectively covering the wall apertures; and a fan and baffle arrangement associated with the second inner wall of the oven cavity and adapted to draw in air from the oven cavity and force the air over the respective inner surfaces of the first and third inner walls.

17. An oven as claimed in claim 16, wherein the heating element comprises a gas burner.

18. An oven as claimed in claim 16, further comprising:

a first air deflector located in the first junction and a second air deflector located in the second junction.

19. An oven as claimed in claim 16, wherein the baffle defines a top end, a bottom end, and longitudinal ends, the top and longitudinal ends define openings which allow air to pass therethrough, and the top end substantially prevents air from passing therethrough.

* * * * *